US009709352B1

(12) United States Patent
Hess

(10) Patent No.: US 9,709,352 B1
(45) Date of Patent: Jul. 18, 2017

(54) AMMUNITION CLIP

(71) Applicant: Troy Hess, Port Huron, MI (US)

(72) Inventor: Troy Hess, Port Huron, MI (US)

( * ) Notice: Subject to any disclaimer, the term of this patent is extended or adjusted under 35 U.S.C. 154(b) by 0 days.

(21) Appl. No.: 14/932,167

(22) Filed: Nov. 4, 2015

(51) Int. Cl.
*F41A 9/84* (2006.01)

(52) U.S. Cl.
CPC ..... *F41A 9/84* (2013.01)

(58) Field of Classification Search
CPC ..... F41A 9/82; F41A 9/83; F41A 9/84; F41A 9/24; F41A 9/25; F41A 9/70
USPC ..... 42/87, 88; 89/34, 33.5
See application file for complete search history.

(56) References Cited

U.S. PATENT DOCUMENTS 205,180 A * 6/1878 Farrington ..... F41A 9/79 89/34
653,389 A * 7/1900 Lee ..... F41A 9/84 42/88
661,743 A * 11/1900 Mauser ..... F41A 9/84 42/88
768,842 A * 8/1904 Bruce ..... F41A 9/84 42/88
810,161 A * 1/1906 Lissak ..... F41A 9/84 42/88
866,080 A * 9/1907 Stapley ..... F41A 9/84 42/88
869,632 A * 10/1907 Hockett ..... F41A 9/84 206/3
1,295,769 A * 2/1919 Kux ..... F41A 9/84 72/129
1,379,075 A * 5/1921 Ashworth ..... F41A 9/84 42/88
2,122,003 A * 6/1938 Cooper ..... F41A 9/84 206/3
2,197,313 A * 4/1940 Nomar ..... F41A 9/84 42/88
2,462,836 A * 3/1949 Barker ..... F41A 9/83 42/87
2,783,570 A * 3/1957 Kunz ..... F41A 9/66 42/18
2,834,137 A * 5/1958 Kunz ..... F41A 9/83 42/87
2,856,720 A * 10/1958 Kunz ..... F41A 9/84 42/87
3,030,724 A * 4/1962 Curran ..... F41A 9/84 42/88
3,032,907 A * 5/1962 Parker ..... F41A 9/84 42/88
3,710,497 A * 1/1973 Musgrave ..... F41A 9/83 42/87

(Continued)

*Primary Examiner* — Derrick Morgan
(74) *Attorney, Agent, or Firm* — Hickman Palermo Becker Bingham LLP

(57) ABSTRACT

In one embodiment, an ammunition clip comprises an elongated channel comprising a first floor, and a first wall and a second wall, the walls extending upwardly from the first floor on opposite longitudinal sides of the floor; a first inwardly facing elongated pawl integrally formed with an inside face of the first wall, and a second inwardly facing elongated pawl integrally formed with an inside face of the second wall; at a first end of the channel, an upwardly protruding stop member on the first floor; at a second end of the channel, in the first floor, an upwardly protruding flexible stop lever, and a longitudinally extending guide tab.

20 Claims, 5 Drawing Sheets

(56) References Cited

U.S. PATENT DOCUMENTS

| | | | | | |
|---|---|---|---|---|---|
| 3,854,232 | A * | 12/1974 | Musgrave | F41A 9/83 | 42/87 |
| 3,916,552 | A * | 11/1975 | Pichard | F41A 9/84 | 42/87 |
| 4,005,633 | A * | 2/1977 | Kirkpatrick | F41A 9/84 | 89/33.02 |
| 4,538,371 | A * | 9/1985 | Howard | F41A 9/83 | 42/87 |
| 4,689,909 | A * | 9/1987 | Howard | F41A 9/83 | 42/87 |
| 4,706,402 | A * | 11/1987 | Csongor | F41A 9/84 | 42/87 |
| 5,669,171 | A | 9/1997 | Sally | | |
| 6,754,987 | B1 * | 6/2004 | Cheng | F41A 9/83 | 42/87 |
| 7,805,874 | B2 * | 10/2010 | Tal | F41A 9/84 | 42/87 |
| 7,866,080 | B2 * | 1/2011 | Tucker | F41A 9/83 | 42/87 |
| 9,115,943 | B1 * | 8/2015 | Jordan | F41A 9/83 | |
| 9,273,917 | B1 | 3/2016 | Buckner | | |
| 2002/0070229 | A1 * | 6/2002 | Cash | F41A 9/84 | 221/289 |
| 2009/0044440 | A1 * | 2/2009 | Tal | F41A 9/84 | 42/87 |

* cited by examiner

AMMUNITION CLIP

FIELD OF THE DISCLOSURE

The present disclosure generally relates to packaging bullets and cartridges for use with firearms such as automatic rifles, and loading magazines of such rifles. The disclosure relates more specifically to an improved ammunition clip capable of serving as a packaging element for bullets and cartridges while also providing high-speed loading of magazines.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Automatic and semi-automatic rifles have become widely used in units of the military, police, and other security services. An example is the AR-15. In some situations, such as combat operations, the ability to rapidly reload the magazine of the rifle is critical. Therefore, the means by which bullets or cartridges are packaged, carried, and moved from packaging to the magazine is an important procedure. In past practice, ammunition manufacturers typically have packaged cartridges in a shipping carrier, such as a divided disposable plastic carrier, which fits inside a cardboard carton or other packaging. In the field, or in an ammunition depot that is controlled by the units of military, police or security services, the cartridges are removed from the manufacturers' packaging and transferred into a stripper clip. In action such as combat, as reloading of the rifle is required, personnel grasp an available stripper clip and load the rifle magazine using the stripper clip.

The stripper clip is a speed loader that holds several cartridges, typically 3 to 10 rounds, together in a single unit for easier and faster loading of the magazine. The stripper clip is used only for loading the magazine and is not necessary for the firearm to function. The term "stripper clip" is used because, after the bolt is opened and the stripper clip is placed in position, generally by placing it in a slot on either the receiver or bolt, the user presses on the cartridges from above, sliding them down and off the clip, thereby "stripping" them off the stripper clip and into the magazine.

Depending on the firearm, magazine and cartridge, stripper clips come in a variety of shapes, some quite complex, though most are either straight or crescent-shaped pieces of stamped metal, usually brass or steel. Some require adapters for effective use with particular magazines. After the magazine is loaded, the stripper clip can be set aside for reloading, but in field combat situations the clips are often simply discarded by dropping them or tossing them aside. In large-scale combat operations, the result is a large volume of metal waste. Moreover, metal stripper clips are not suitable for serving as packaging or shipping material for ammunition due to weight and bulk.

SUMMARY

The appended claims may serve as a summary of the invention.

Figure 1:
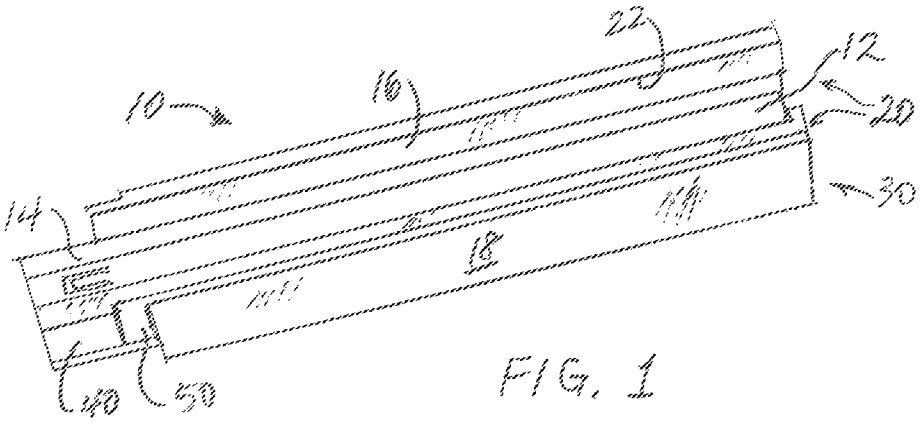
FIG. 1 is a perspective view of an ammunition clip.

The drawings are not rendered to scale.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

In general, the embodiments described in this disclosure provide an improved ammunition clip that may function either as a packaging element to support, cushion and separate bullets or rifle cartridges during shipping, or as a stripper clip, or both. The embodiments described herein may be made of lightweight, recyclable materials, resulting in less waste. Embodiments also provide the ability to rapidly move ammunition from a manufacturer or vendor's packaging to the magazine without transferring ammunition from packaging to a separate stripper clip. Embodiments further may use a compact geometry that permits more ammunition to be stored or shipped per cubic meter as compared to past units.

In one embodiment, the disclosure presents a single piece, polypropylene, glass filled, injection molded ammunition strip designed to retain 10 rounds of 0.223, 5.56×45 mm or 0.300 blackout ammunition in its packaging container until desired use, at which point all 10 rounds can be rapidly loaded into a box magazine of the M4 or AR-15 rifle by aligning the feed end of the strip to the top rear spine area of the magazine feeder end. Once fully seated, by pressing low on the casing of the rearmost bullet, the bullets overcome a stopper on the forward channel of the stripper and the magazine spring tension, and load directly into the magazine.

1. GLOSSARY

Reference numerals in the text and drawings correspond to elements of embodiments according to the following list:

10 ammunition clip
12 elongated channel
14 first floor
16 first wall
18 second wall

20 opposite longitudinal sides of the floor
22 first inwardly facing elongated pawl
24 inside face of the first wall
26 second inwardly facing elongated pawl
28 inside face of the second wall
30 first end of the channel
32 upwardly protruding stop member
36 second end of the channel
38 upwardly protruding flexible stop lever
40 longitudinally extending guide tab
41 hole
42 longitudinally elongated secondary floor
44 lateral width
46 lateral separation of the first pawl and the second pawl
60 bullet
62 base ring
64 base
66 shoulder
68 side wall

2. EXAMPLE IMPROVED AMMUNITION CLIP

Figure 2:
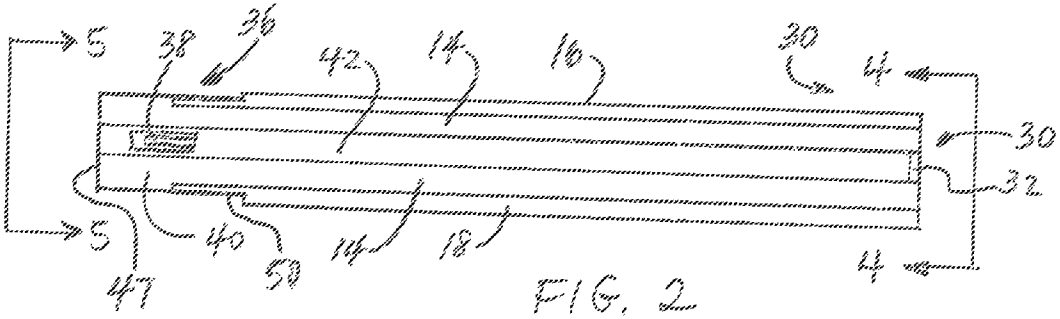
FIG. 2 is a top plan view of the ammunition clip of FIG. 1.
Figure 3:
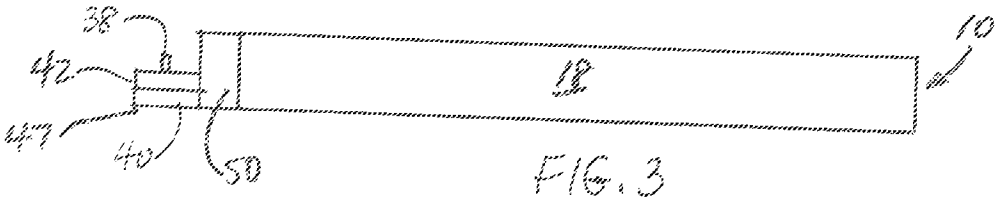
FIG. 3 is a first side elevation view of the ammunition clip of FIG. 1.
Figure 4:
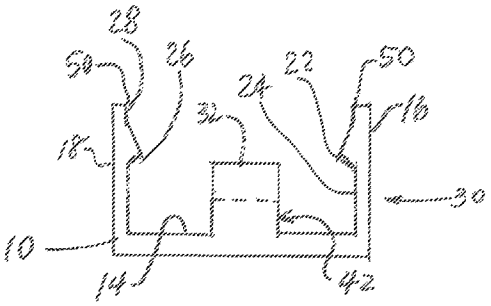
FIG. 4 is a first end elevation view of the ammunition clip of FIG. 1 viewed from the end indicated by line 4-4 of FIG. 2.
Figure 5:
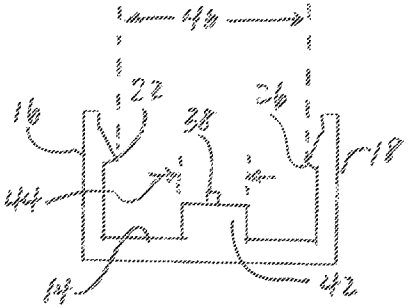
FIG. 5 is a first end elevation view of the ammunition clip of FIG. 1 viewed from the end indicated by line 5-5 of FIG. 2.
Figure 7:
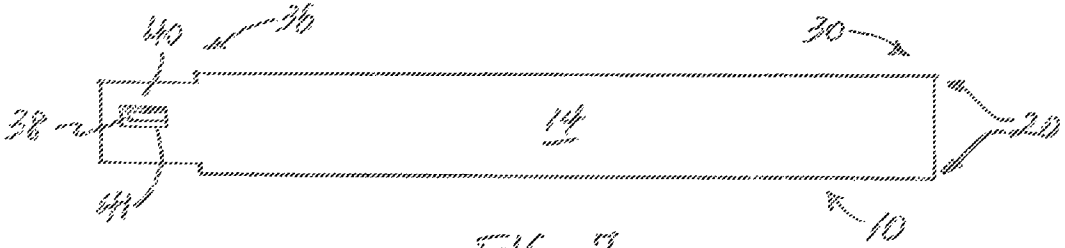
FIG. 7 is a bottom plan view of the ammunition clip of FIG. 1.

FIG. 1 is a perspective view of an ammunition clip; FIG. 2 is a top plan view of the ammunition clip of FIG. 1; FIG. 3 is a first side elevation view of the ammunition clip of FIG. 1; FIG. 4 is a first end elevation view of the ammunition clip of FIG. 1 viewed from the end indicated by line 4-4 of FIG. 4; FIG. 5 is a second end elevation view of the ammunition clip of FIG. 1 viewed from the end indicated by line 5-5 of FIG. 5; FIG. 7 is a bottom plan view of the ammunition clip of FIG. 1.

Referring first to FIG. 1, in one embodiment, that is, according to just one example configuration, an ammunition clip comprises a linearly elongated channel 12 comprising a first floor 14, a first wall 16 and a second wall 18, the walls 16, 18 extending upwardly from the first floor 14 on opposite longitudinal sides 20 of the floor 14. Each of the foregoing parts may have rectangular geometry.

A first inwardly facing elongated pawl 22 is integrally formed with an inside face 24 of the first wall 16, and a second inwardly facing elongated pawl 26 is integrally formed with an inside face 28 of the second wall 18. Each pawl 22, 26 is linearly elongated and extends along essentially the entire length of the channel 12. While each pawl 22, 26 is depicted having inwardly angled upper faces, that geometry is not critical and the pawls could be formed using short generally horizontal or downwardly angled and laterally inwardly protruding walls.

At a first end 30 of the channel 12, an upwardly protruding stop member 32 is formed in the first floor 14. The stop member 32 may comprise, in one embodiment, a rectangular wall that is upwardly protruding with respect to the first floor 14. In this position the stop member 32 provides a positive stop for bullets or cartridges that are loaded into the clip and slid along the channel 12 to stop against the stop member, as further described below. As seen in FIG. 4, in one embodiment the stop member 32 may extend upwardly approximately as high as lower faces of the pawls 22, 26, but the height of the stop member is not critical and different dimensioning may be used provided that the stop member functions to stop the longitudinal movement of bullets or cartridges that are placed in the clip 10.

In an embodiment, optionally the ammunition clip 10 further comprises a longitudinally elongated secondary floor 42 that is formed integrally with and extends upwardly from the first floor 14, extending between the first end 30 and the second end 36, and having a lateral width 44 less than a lateral width of the first floor. The secondary floor 42 has the benefit of providing a sliding surface having less overall surface area than the first floor 14, which may reduce friction imparted against the bases of bullets or cartridges that are placed in or slid into the clip 10. Use of the secondary floor 42 is not required and other embodiments may use a fully flat first floor 14 without a secondary floor extending upward from the first floor.

In embodiments with the secondary floor 42 as seen in the drawings, at a second end 36 of the channel 12, in the first floor 14, an upwardly protruding flexible stop lever 38 is formed extending into a hole 41 adjacent to a longitudinally extending guide tab 40. The upwardly protruding flexible stop lever is adapted to flex downwardly to a position planar with the floor in response to lateral sliding pressure across the floor of one or more cartridges that are in the clip.

The stop lever 38 may comprise a portion of the same material as used for surrounding elements which protrudes like a tongue and features an upstanding pin or boss that serves as a stop member for the second end 36 of the channel 12. The upstanding pin provides sufficient resistance to prevent cartridges or bullets from sliding past the stop lever unless urged toward it with pressure. That is, under normal clip loading and shipping conditions, cartridges will not move past the stop lever. However, because the stop lever 38 is fixed at only one end and has one unattached end that can flex within the hole 41, firm longitudinal pressure against the upstanding pin will cause the stop lever to flex downward below or planar with the secondary floor 42, thereby allowing bullets or cartridges to slide past the stop lever and off the clip 10, for example, into a rifle magazine. Therefore, the stop lever 38 serves to retain bullets or cartridges in the clip, together with the stop member 32, during shipping or initial handling, but also permits bullets or cartridges to be rapidly slid out of the clip 10 to load a magazine or for other uses.

In an embodiment, the longitudinally extending guide tab 40 is adapted to snugly engage a rifle magazine. As further described below, when the clip 10 is partly or wholly filled with bullets or cartridges, a magazine may be loaded by placing the guide tab 40 in or against a receiver element of the magazine. Dimensions and geometry of the guide tab 40 may vary according to the dimensions or geometry of a corresponding magazine feeder end with which compatibility is desired and the dimensions and geometry of guide tab 40 as shown in the drawing figures are not critical. In an embodiment, the guide tab 40 extends longitudinally beyond the ends of the walls 16, 18 at the second end 36 of the channel 12, and the stop lever 38 is positioned in the secondary floor 42 also at a position just outward of the second end of the channel.

With this configuration, bullets and cartridges are retained in the clip 10 in a row that is slightly separated from the distal end 47 of the guide, which permits the clip to be fitted into or against a magazine feeder end without fouling the position of the bullets and cartridges. Each of the walls 16, 18 may comprise a slightly thinned stop section 50 which acts to stop the walls against corresponding walls of the magazine. In this position, bullets or cartridges may be pressed or slid along the channel 12 toward and over the stop lever 38 and into the magazine without falling out of the clip, that is, without falling out a gap between the clip and the magazine.

In one embodiment, the first wall 16 and second wall 18 are formed of a material that may outwardly flex in response to downward pressure of a rifle cartridge on upper surfaces 50 of the first wall and second wall. This feature may be best understood with reference to FIG. 4, FIG. 5, and FIG. 6.

Figure 6:
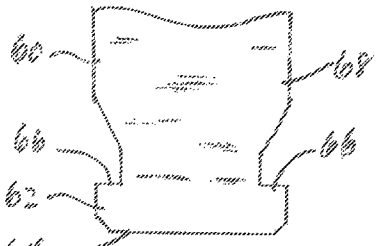
FIG. 6 is a partial side elevation view of a lower portion of an example bullet.

FIG. 6 is a partial side elevation view of a lower end of an example bullet 60 having a base 64, an annular base ring 62, shoulders 66 and an outer wall 68. Bullet 60 may be any of .223 caliber, 5.56×45 mm caliber or .300 blackout caliber ammunition, for example. Typically a diameter of the bullet, which corresponds to a width of the bullet 60 in FIG. 6 and is also equivalent to caliber, will be just slightly greater than a lateral separation 46 of the first pawl and the second pawl yet narrower than a width of the first floor 14, or less than the separation of walls 16, 18 to form the channel 12.

Use of the apparatus, either as a method of manufacturing or in the form of end-user use in the field or in another location, may proceed as follows. Assume that the bullet 60 is lifted and the base 64 is placed on one or both of the upper surfaces 50 of the first wall 16 and second wall 18 of the ammunition clip as seen in FIG. 4. From that position, downward pressure on the bullet 60 will cause the base 64 to urge the first wall 16 and second wall 18 outwardly laterally a slight amount, pushing apart the pawls 22, 26, so that with continued downward pressure the base 64 will pass the pawls and come to rest on the secondary floor 42 or, if the secondary floor is not present, on the first floor 14.

In this position, the shoulders 66 above the base ring 62 are snugly retained in place by the pawls 22, 26, thereby retaining the bullet in the clip and retarding upward or downward movement out of the clip. However, the bullet 60 still may slide longitudinally along the clip, for example, until the bullet rests against the stop member 32 at the first end 30 of the channel 12. Therefore, the user or a manufacturer may repeat the foregoing process for other bullets 60 until the clip is fully filled.

To permit loading in this manner, typically the ammunition clip 10 may be formed or manufactured using a material for which thick walls are relatively rigid yet thin walls are slightly flexible. Examples include polypropylene, polystyrene, other similar polymers, aluminum, brass, and other softer or more flexible metals. In one specific embodiment, the ammunition clip 10 is integrally formed using injection molding as a single piece having the geometry shown in the drawings. In a particular embodiment, the ammunition clip comprises a glass fiber reinforced plastic. For example, the inventor has found that 10% glass filled polypropylene, with injection molding, is a workable combination. Other embodiments may be made using a plastic reinforced with from 5% to 50% glass fiber. Use of glass fiber essentially makes plastics such as polypropylene more slick, thereby reducing friction when bullets or cartridges are slid in the clip. Therefore, any amount of glass fill may be used that is found to effectively reduce friction.

The drawing figures are not shown to scale and in general the dimensions of the ammunition clip 10 are not critical. For example, while FIG. 1, FIG. 2, FIG. 3, FIG. 7 depict an elongated unit having a length to width ratio of approximately 10:1, other embodiments could vary in length according to length to width ratios of 2:1 to 20:1 or more. Similarly, different embodiments of the ammunition clip could hold different numbers of bullets or cartridges. Standard ammunition packaging often involves clips of ten cartridges but this number is not a rigid requirement and any number from 1 to 30 or more could be used depending on caliber.

The lateral width of the clip also may vary and may be selected based upon the caliber of ammunition to be carried or packaged in the clip. In an embodiment, the first floor 14 simply has a lateral width that snugly retains a rifle cartridge in the ammunition clip. Various embodiments may have a floor 14 and other dimensions sized to snugly carry ammunition having a caliber of any one of: .223 caliber; 5.56×45 mm caliber; .300 black out caliber; or others.

Embodiments are specifically contemplated for any standard or known caliber between .17 and .50, including all metric equivalents within the aforesaid range. Thus, in one embodiment, in ammunition clip 10, a lateral separation of the first pawl 22 and the second pawl 26 is just less than or equal to a diameter of an annular channel of a .223 caliber rifle cartridge and a length of the channel 12 may be equal to a sum of diameters of ten .223 caliber rifle cartridges within a tolerance of 5 mm.

Based upon the foregoing description, it will be clear that the ammunition clip 10 can be used as part of a method of manufacturing a clip of ammunition that can be packaged and shipped to end consumers. In an embodiment, the manufacturing method comprises obtaining a plurality of ammunition clips of the type described herein, and a set of cartridges; exerting downward pressure on one or more rifle cartridges of the set of cartridges, thereby causing one or more bases of the one or more rifle cartridges to outwardly flex the first wall and the second wall and pass the first pawl and second pawl to rest upon the floor, with the first pawl and the second pawl snugly engaging the one or more bases; and repeating the obtaining and exerting, for all the ammunition clips and cartridges.

As part of this method, exerting the downward pressure may comprise causing one or more annular channels of the one or more bases to snugly engage the first pawl and the second pawl. The set of cartridges can be any that are compatible with the clip 10, including but not limited to .223 caliber; 5.56×45 mm caliber; or .300 black out caliber.

Similarly, a method of manufacturing a clip of ammunition can comprise: obtaining a plurality of ammunition clips as set forth in claim 1, and a set of cartridges; exerting side pressure on one or more rifle cartridges of the set of cartridges, thereby causing one or more bases of the one or more rifle cartridges to slide into the channel on the floor and under the first pawl and second pawl to rest upon the floor, with the first pawl and the second pawl snugly engaging the one or more bases; and repeating the obtaining and exerting, for all the ammunition clips and cartridges.

These methods may be used in high-speed assembly line environments to rapidly produce large quantities of filled ammunition clips that are suitable for direct packaging and shipping. Clips that have been fabricated and loaded in this manner may be packaged in cartons and packed and shipped in a conventional manner. As an example, two ten-round clips could be packaged in a single carton providing a 20-round package. A benefit of this approach is that the ammunition clip 10 of this disclosure can serve both as a holder or retainer for cartridges in a carton or other packaging during transit from the point of manufacture to the point of use, and as a stripper clip. A separate fixture or holder that is loaded and used within the packaging from manufacture to transit, acting as a filler piece, followed by transfer to a separate stripper clip for field use, is not required. Therefore the end-to-end process of manufacturing to use will involve a reduced amount of material and waste.

Figure 8:
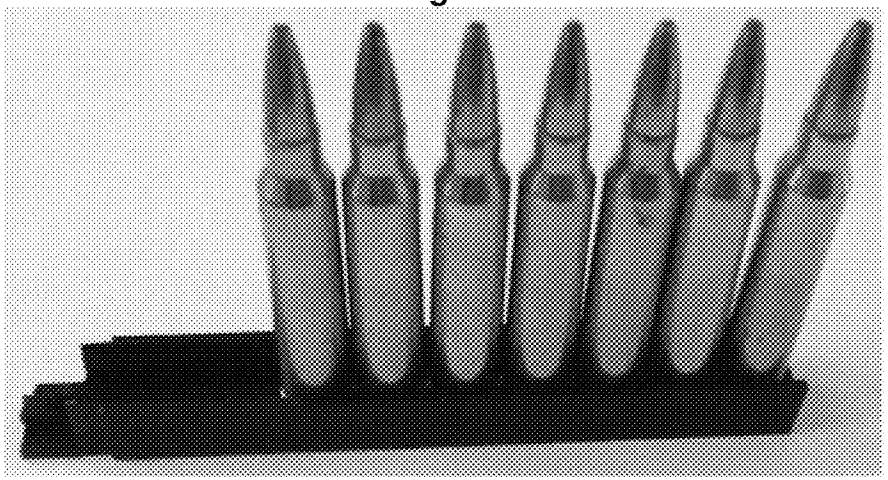
FIG. 8 is a perspective view of the ammunition clip of FIG. 1, partly loaded.
Figure 9:
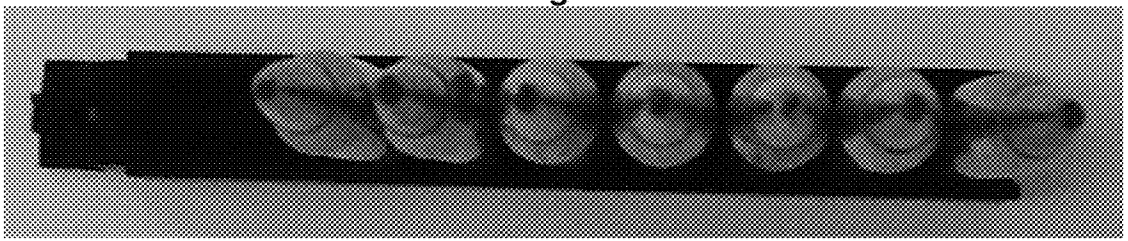
FIG. 9 is a top plan view of the ammunition clip of FIG. 8.
Figure 10:
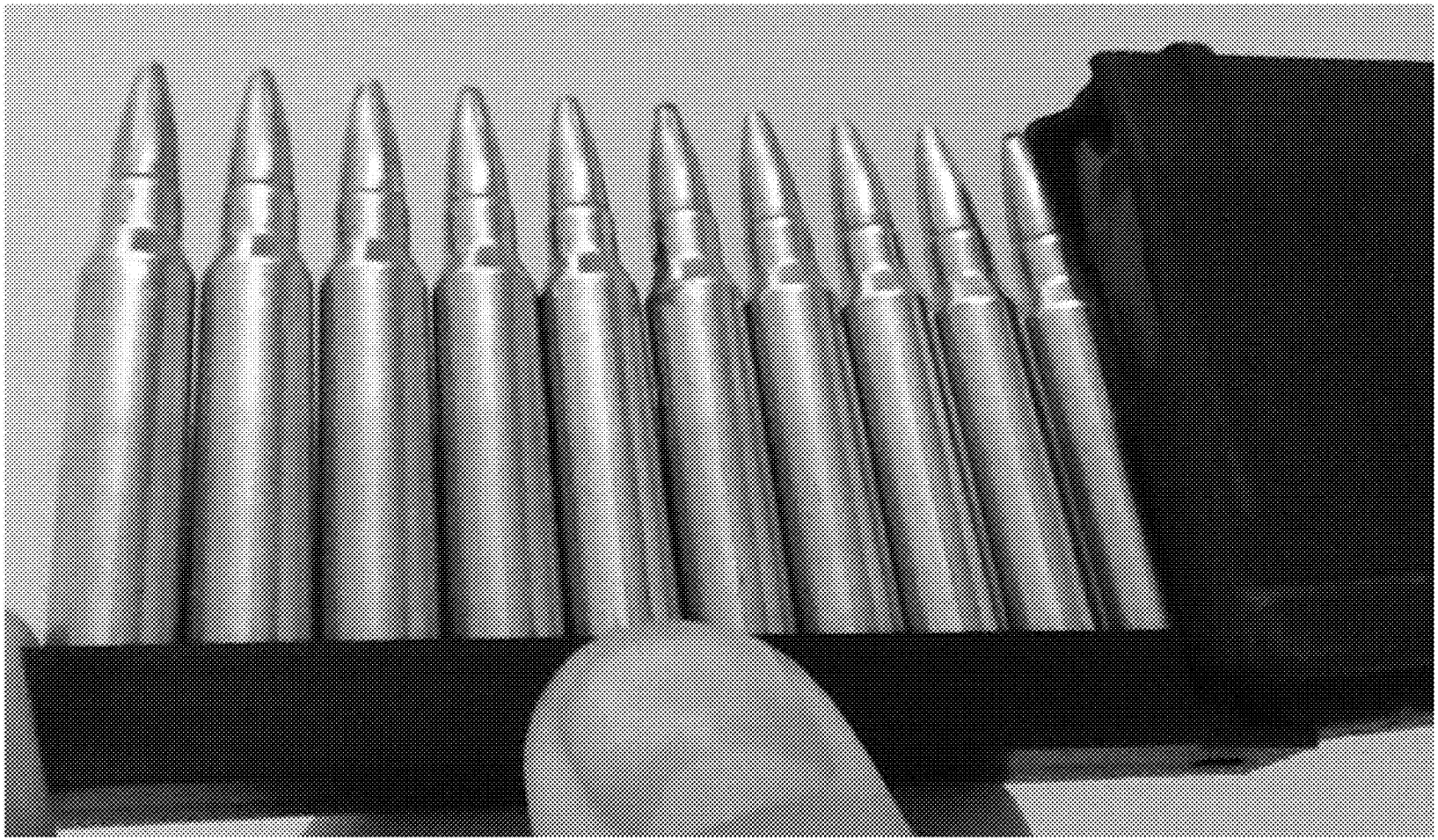
FIG. 10 is a perspective view of the ammunition clip of FIG. 8, FIG. 9 in relation to an example magazine.

To illustrate the result of using the foregoing example structure and the foregoing process, FIG. 8 is a perspective view of the ammunition clip of FIG. 1, partly loaded. FIG. 9 is a top plan view of the ammunition clip of FIG. 8. FIG. 10 is a perspective view of the ammunition clip of FIG. 8, FIG. 9 in relation to an example magazine.

The disclosure also encompasses the ornamental design of a rifle ammunition clip, as shown and described.

3. EXTENSIONS AND VARIATIONS

In the foregoing specification, embodiments of the invention have been described with reference to numerous specific details that may vary from implementation to implementation. The specification and drawings are, accordingly, to be regarded in an illustrative rather than a restrictive sense. For example, for purposes of illustrating clear examples, parts of this description refer to particular caliber of bullets or cartridges, but embodiments may be adapted and formed for use with any caliber from .17 to .50 by changing the lateral width of the channel 12, the size of the pawls 22, 26, the size of the tab 40, and so forth. Embodiments are specifically contemplated for use with the M4/AR-15, AK-47, FN SCAR 17/Mk 17, FN FAL, FN five-seven, M1A/M-14, AK-74 and other AK variants, or any other platform utilizing a magazine designed to feed any of the previously mentioned platforms.

Therefore, the sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An ammunition clip comprising:

an elongated channel comprising a first floor, and a first wall and a second wall, the walls extending upwardly from the first floor on opposite longitudinal sides of the first floor;

a longitudinally elongated secondary floor formed integrally with and extending upwardly from the first floor, extending between the first end of the channel and the second end of the channel, and having a lateral width less than the first floor;

a first inwardly facing elongated pawl integrally formed with an inside face of the first wall, and a second inwardly facing elongated pawl integrally formed with an inside face of the second wall;

at a first end of the channel, an upwardly protruding stop member on the first floor;

at the second end of the channel, in the first floor, an upwardly protruding flexible stop lever formed extending into a hole through the first floor and the secondary floor that is adjacent to a longitudinally extending guide tab, the flexible stop lever comprising a portion of the same material as the first floor and having a first end fixed integral with the first floor and an unattached second end having an upstanding pin and that can flex downwardly into the hole.

2. The ammunition clip of claim 1, wherein the first wall and the second wall are formed of a material that may outwardly flex in response to downward pressure of a rifle cartridge on upper surfaces of the first wall and the second wall.

3. The ammunition clip of claim 1, wherein at least the channel comprises a glass fiber reinforced plastic.

4. The ammunition clip of claim 1, wherein at least the channel comprises injection molded polypropylene reinforced with 5% to 50% glass fiber.

5. The ammunition clip of claim 1, wherein the first elongated pawl and the second elongated pawl have a lateral spacing that retains a rifle cartridge in the ammunition clip.

6. The ammunition clip of claim 1, wherein the first elongated pawl and the second elongated pawl have a lateral spacing that retains a .223 caliber rifle cartridge in the ammunition clip.

7. The ammunition clip of claim 1, wherein the first elongated pawl and the second elongated pawl have a lateral spacing that retains a rifle cartridge in the ammunition clip, wherein the rifle cartridge has a caliber of any one of 5.56×45 mm caliber; or .300 black out caliber.

8. The ammunition clip of claim 1, wherein a lateral separation of the first pawl and the second pawl is less than a diameter of an annular channel of a .223 caliber rifle cartridge.

9. The ammunition clip of claim 1, wherein a length of the channel is equal to a sum of diameters of ten .223 caliber rifle cartridges within a tolerance of 5 mm.

10. The ammunition clip of claim 1, wherein the upwardly protruding flexible stop lever is adapted to flex downwardly to a position planar with the secondary floor in response to longitudinal sliding pressure, across the secondary floor, of one or more cartridges that are in the clip.

11. The ammunition clip of claim 1, wherein the longitudinally extending guide tab is adapted to engage a rifle magazine.

12. An ammunition clip comprising:

an elongated channel comprising a first floor, and a first wall and a second wall, the walls extending upwardly from the first floor on opposite longitudinal sides of the first floor;

a longitudinally elongated secondary floor formed integrally with and extending upwardly from the first floor, extending between the first end and the second end, and having a lateral width less than the first floor;

a first inwardly facing elongated pawl integrally formed with an inside face of the first wall, and a second inwardly facing elongated pawl integrally formed with an inside face of the second wall;

at a first end of the channel, an upwardly protruding stop member on the first floor;

at a second end of the channel, in the first floor, an upwardly protruding flexible stop lever formed extending into a hole through the first floor and the secondary floor that is adjacent to a longitudinally extending guide tab adapted to engage a rifle magazine, the flexible stop lever comprising a portion of the same material as the first floor and having a first end fixed integral with the first floor and an unattached second end having an upstanding pin and that can flex downwardly into the hole;

wherein the first wall and second wall are formed of a material that may outwardly flex in response to downward pressure of a rifle cartridge on upper surfaces of the first wall and second wall;

wherein the first elongated pawl and the second elongated pawl have a lateral spacing that retains a rifle cartridge in the ammunition clip, wherein the rifle cartridge has a caliber of any one of .223 caliber; 5.56×45 mm caliber; or .300 black out caliber.

13. The ammunition clip of claim 12, wherein at least the channel comprises injection molded polypropylene reinforced with 5% to 50% glass fiber.

14. The ammunition clip of claim 12, wherein a length of the channel is equal to a sum of diameters of ten cartridges.

15. The ammunition clip of claim 12, wherein the upwardly protruding flexible stop lever is adapted to flex downwardly to a position planar with the secondary floor in response to longitudinal sliding pressure across the secondary floor of one or more cartridges that are in the clip.

16. A method of manufacturing a clip of ammunition, the method comprising:

obtaining a plurality of ammunition clips as set forth in claim 1, and a set of cartridges;

exerting downward pressure on one or more rifle cartridges of the set of cartridges, thereby causing one or more bases of the one or more rifle cartridges to outwardly flex the first wall and the second wall and pass the first pawl and second pawl to rest upon the first floor, with the first pawl and the second pawl engaging the one or more bases;

repeating the obtaining and exerting, for all the ammunition clips and cartridges.

17. The method of claim 16, wherein exerting the downward pressure comprises causing one or more annular channels of the one or more bases to engage the first pawl and the second pawl.

18. The method of claim 16, wherein the set of cartridges comprises one of .223 caliber cartridges; 5.56×45 mm caliber cartridges; or .300 black out caliber cartridges.

19. A method of manufacturing a clip of ammunition, the method comprising:

obtaining a plurality of ammunition clips as set forth in claim 1, and a set of cartridges;

exerting side pressure on one or more rifle cartridges of the set of cartridges, thereby causing one or more bases of the one or more rifle cartridges to slide into the channel on the first floor and under the first pawl and second pawl to rest upon the first floor, with the first pawl and the second pawl engaging the one or more bases;

repeating the obtaining and exerting, for all the ammunition clips and cartridges.

20. The method of claim 19, wherein the set of cartridges comprises one of .223 caliber cartridges; 5.56×45 mm caliber cartridges; or .300 black out caliber cartridges.

* * * * *